US005868263A

United States Patent [19]

McAllister et al.

[11] Patent Number: 5,868,263

[45] Date of Patent: Feb. 9, 1999

[54] WALL MOUNTED STORAGE SYSTEM

[75] Inventors: Larry N. McAllister; William L. Bartz, Jr., both of Dover; John D. Poore, Smyrna, all of Del.

[73] Assignee: Metal Masters Foodservice & Equipment Co., Inc., Clayton, Del.

[21] Appl. No.: 712,259

[22] Filed: Sep. 11, 1996

[51] Int. Cl.[6] ..... A47F 5/00

[52] U.S. Cl. ..... 211/90.01; 211/103; 211/106; 248/243; 248/249; 108/108

[58] Field of Search ..... 211/90, 106, 103, 211/70.7, 187; 248/249, 250, 243; 108/108

[56] References Cited

U.S. PATENT DOCUMENTS

| | | | |
|---|---|---|---|
| 2,428,073 | 9/1947 | Handel . | |
| 2,560,880 | 7/1951 | Lundqvist . | |
| 2,665,869 | 1/1954 | Samuels . | |
| 3,172,540 | 3/1965 | Berge . | |
| 3,194,528 | 7/1965 | Chesley | 248/250 |
| 3,269,556 | 8/1966 | Streater | 248/250 X |
| 3,294,351 | 12/1966 | Rollins | 211/90 X |
| 3,993,002 | 11/1976 | Stroh | 211/90 X |
| 4,086,858 | 5/1978 | Howitt . | |
| 4,250,815 | 2/1981 | Swanson . | |
| 4,348,965 | 9/1982 | Swanson . | |
| 4,429,850 | 2/1984 | Weber et al. . | |
| 4,542,832 | 9/1985 | Minick et al. . | |
| 4,577,092 | 3/1986 | Lenoir . | |
| 4,777,888 | 10/1988 | Waterman et al. | 248/249 X |
| 4,884,702 | 12/1989 | Rekow . | |
| 5,346,077 | 9/1994 | Randall | 211/90 |
| 5,482,168 | 1/1996 | Welch et al. . | |
| 5,592,886 | 1/1997 | Williams et al. | 248/250 X |
| 5,611,440 | 3/1997 | Moller | 211/70.7 |

FOREIGN PATENT DOCUMENTS

| | | |
|---|---|---|
| 1230856 | 5/1971 | United Kingdom . |

*Primary Examiner*—Robert W. Gibson, Jr.
*Attorney, Agent, or Firm*—Connolly & Hutz

[57] ABSTRACT

A wall mounted storage system includes at least one pair of spaced apart vertical hanger bars for attachment to a studded wall or comparable structure. At least one removable shelf support bracket is associated with each hanger bar, and the bracket is removably connected to the bar at any one of a plurality of vertical locations along the bar. A shelf is supported by the brackets and releasably attached thereto by rear hooks on the brackets that hook over the rear rail of the shelf. An upwardly extending retainer loop on each bracket extends through the shelf and engages the front rail thereof. The hooks and loops on the shelf brackets interact with the shelf to positively secure the shelf in place and prevent it from tipping or shifting forward or sideways. Horizontal spacing of the hanger bars is not critical and the shelf may be releasably secured to the brackets even when the horizontal distance between the bars varies from one location to another. Also, longer or shorter shelves may be used as long as the length is sufficient to span the distance between the brackets. A vertical storage grid may be removably secured to the hanger bars for holding a variety of implements such as kitchen utensils.

6 Claims, 3 Drawing Sheets

50
12
40
16
34
22
38
24

12
42
14
44

10
54
22
24
38
30
44
52
14
18
26
36
20
16

WALL MOUNTED STORAGE SYSTEM

BACKGROUND OF THE INVENTION

The present invention relates to a storage system, and more particularly to a wall mounted storage system including horizontal shelving releasably attached to shelf support brackets which in turn are releasably attached to vertical hanger bars secured to a wall.

Known shelving systems include those where the shelves are moveable relative to the shelf brackets so that each shelf bracket may engage a shelf at a variety of horizontal locations. These systems are advantageous because they allow vertical uprights to which the brackets are secured to be directly mounted to the wall studs or comparable support structures. Such systems also allow shelves to be supported at various locations relative to the mounted uprights. However, these systems suffer from at least one drawback in that the shelves are not supported in a stable and efficient manner. In some instances costly and/or complicated bracket structure is provided to anchor the shelf to the brackets.

SUMMARY OF THE INVENTION

Accordingly, one of the objects of the present invention is a wall mounted storage system where vertical hanger bars are secured to wall studs or comparable support structure and shelf brackets are efficiently and safely secured to the hanger bars.

Another object of the present invention is a wall mounted storage system where the horizontal shelving is movable relative to the shelf brackets but otherwise is secured to the shelf brackets in a reliable and safe manner, and where shelf tipping and forward and sideways shifting are prevented.

Still another object of the present invention is a wall mounted storage system which is simple to use, reliable, safe and efficient.

In accordance with the present invention, a wall mounted storage system comprises at least one pair of spaced apart vertical hanger bars. Each bar has a plurality of vertical slots equally spaced apart along the length of the bar. A shelf support bracket is associated with each vertical hanger bar, and each bracket has a pair of vertical spaced apart horizontal mounting pins for placement within an adjacent pair of vertical slots in its associated hanger bar to thereby releasably secure the brackets to the bars. A horizontal shelf spans the shelf brackets and is supported thereby. The shelf includes front and rear rails, and shelf hooks on the shelf brackets engage the rear rail of the shelf to thereby releasably secure the shelf to the shelf brackets.

Preferably each shelf support bracket also includes a upwardly extending retainer loop which engages the front rail of the shelf. The shelf includes openings through which the retainer loops extend.

Preferably the hanger bars each comprise a base plate for attachment to a wall. Integral side plates extend outwardly from the base plate, and each side plate includes the plurality of vertical slots equally spaced apart along the length of the bar to thereby provide horizontally opposed pairs of vertical slots along each hanger bar. Each of the horizontal mounting pins on the shelf support bracket releasably engages a horizontally opposed pair of vertical slots on its associated hanger bar.

The wall mounted storage system of the present invention may also include a plurality of second vertical slots equally spaced apart along the hanger bars. A vertical storage grid is releasably secured to the hanger bars. The grid has vertically spaced apart horizontal stringers for placement within the second vertical slots in the hanger bars.

BRIEF DESCRIPTION OF THE DRAWINGS

Novel features and advantages of the present invention in addition to those noted above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
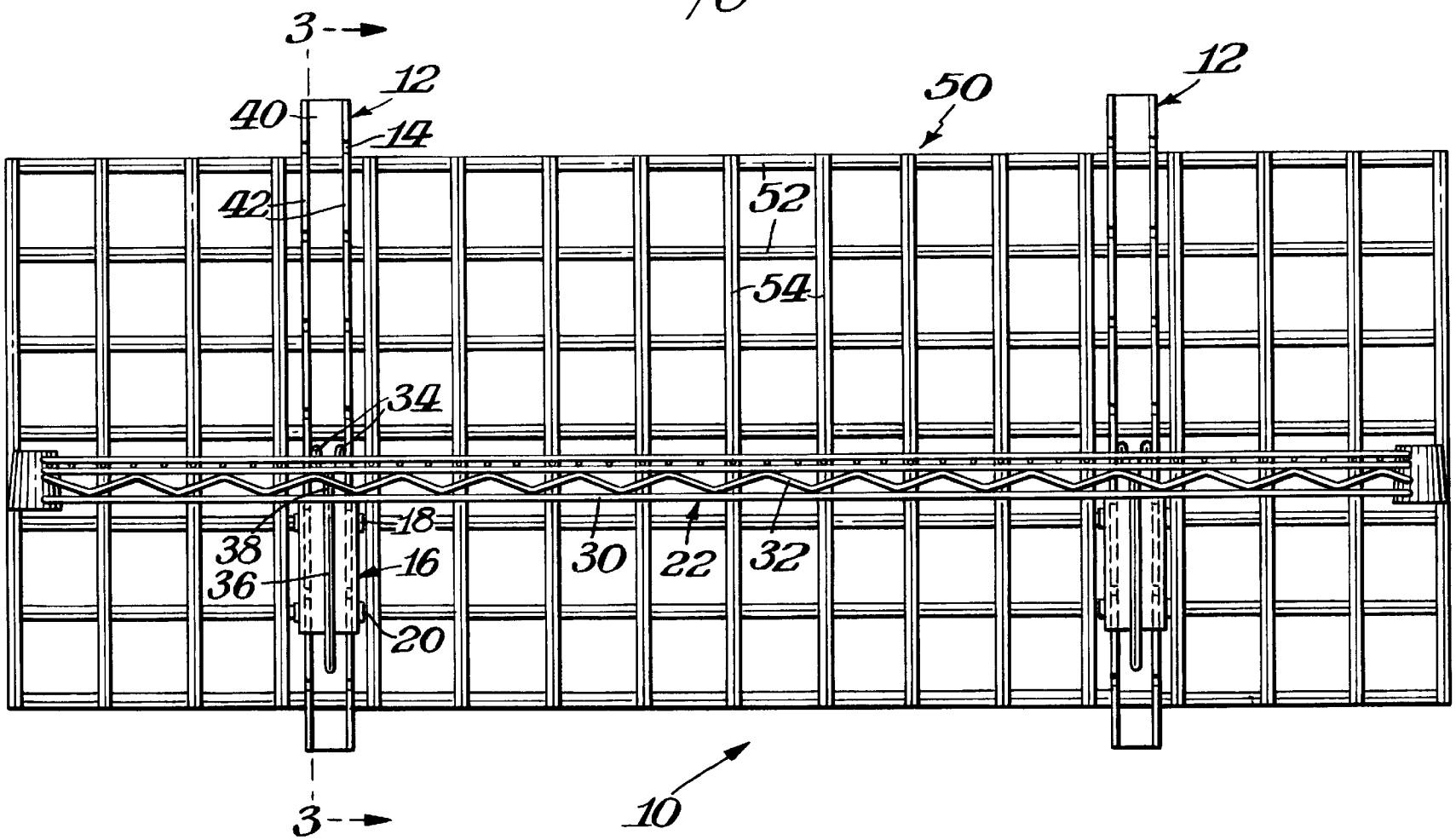
FIG. 1 is a front elevational view of a wall mounted storage system, according to the present invention.
Figure 3:
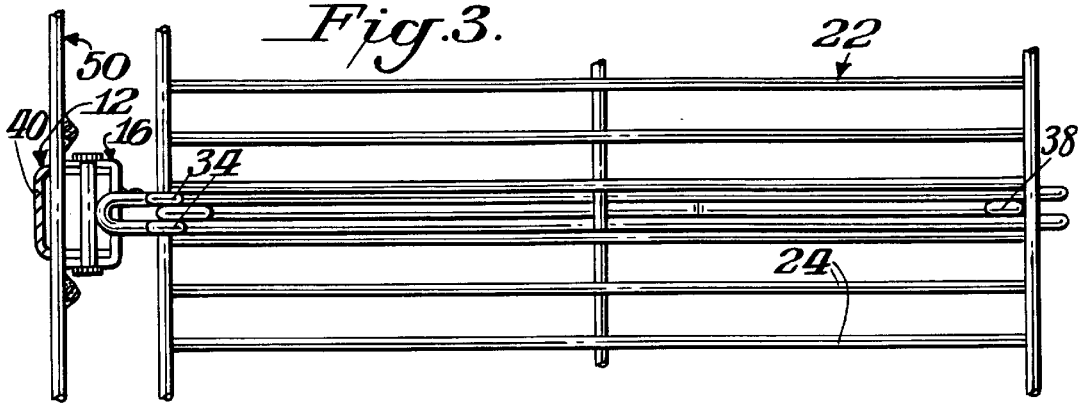
FIG. 3 is a fragmental top plan view illustrating one vertical hanger bar, a shelf support bracket and a portion of a shelf, according to the present invention.

Referring in more particularity to the drawings, a wall mounted storage system 10 comprises at least one pair of spaced apart vertical hanger bars 12 for attachment to wall studs or comparable support structures. Each hanger bar has a plurality of vertical slots 14 equally spaced apart along the length of the bar. A shelf support bracket 16 is associated with each vertical hanger bar 12, and each bracket 16 includes a pair of vertically spaced apart horizontal mounting pins 18, 20 at the rear end of the bracket. As shown best in FIG. 4, the mounting pins are constructed and arranged for placement within an adjacent pair of vertical slots 14 in the hanger bar to thereby releasably secure the shelf brackets to the hanger bars.

A shelf 22 primarily constructed of criss-crossing wire stringers 24 spans shelf brackets 16 and rests upon an upper horizontal leg 26 of each bracket. Shelf 22 also includes a rear rail 28 and a front rail 30. Both rails are similarly constructed and each includes a serpentine brace 32. As explained more fully below, each shelf bracket 16 includes a pair of upwardly extending shelf hooks 34 at the rear of the bracket which engage rear rail 28 of the shelf to thereby releasably secure the shelf to the shelf brackets.

Additional hanger bars, shelf support brackets and shelves may be incorporated into the storage system, if desired. For example, a third hanger bar may be secured to the wall and multiple shelves may be secured to each adjacent pair of bars.

Each shelf support bracket 16 also includes bracing 36 and an upwardly extending retainer loop 38 at the front end of the bracket. The retainer loop extends through openings in the wire shelving 22 between the wire stringers and directly engages front rail 30. Shelf hooks 34 function to positively lock shelf 22 in place on shelf bracket 16. This interaction prevents tilting of the shelf as well as forward and sideways movement of the shelf relative to the hanger bars and shelf brackets. Additionally, the retainer loops 38 function to further stabilize the shelf and prevent unwanted sideways movements.

Figure 2:
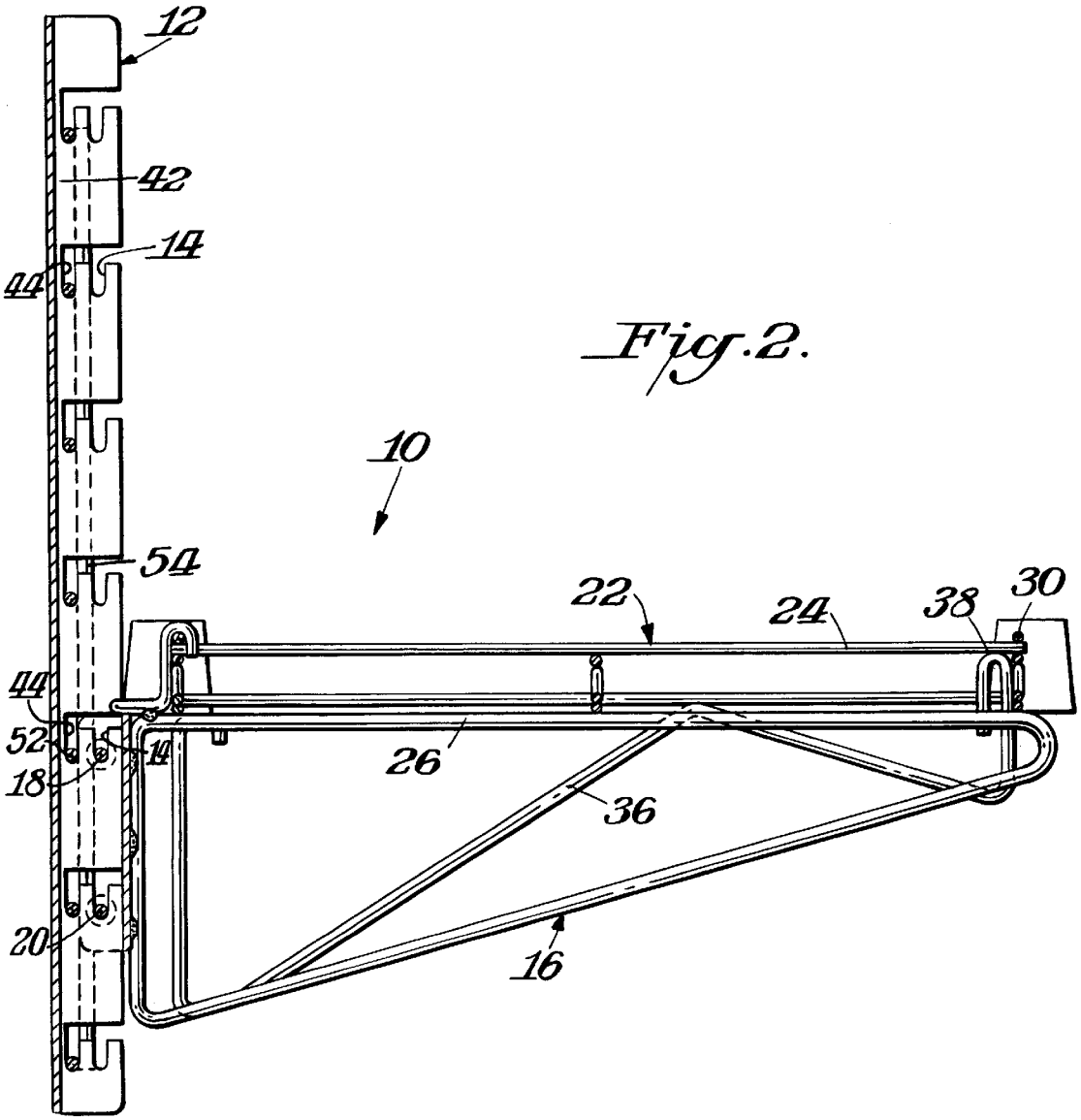
FIG. 2 is a cross-sectional side elevational view taken along line 2—2 of FIG. 1.

The hanger bars are shown in detail in FIG. 2. Each hanger bar 12 comprises a base plate 40 for attachment to a wall or similar surface. Integral side plates 42 extend outwardly from the base plate, as shown. Each of the side plates has the vertical slots 14 equally spaced apart along the length of the bar. The vertical slots in the side plates define horizontally opposed pairs of vertical slots 14 along hanger bar 12, and each horizontal mounting pin 18, 20 releasably engages a horizontally opposed pair of vertical slots 14 on its associated hanger bar.

Hanger bars 12 also include a plurality of second vertical slots 44 equally spaced apart along the length of the hanger bars. The second vertical slots are adjacent the vertical slots 14 and positioned closer to base plate 40. Moreover, the second slots 44 are provided in each of the integral side plates 42.

The wall mounted storage system 10 of the present invention also includes a vertical storage grid 50 having vertically spaced apart horizontal stringers 52 and horizontally spaced apart vertical stringers 54. Horizontal stringers 52 are arranged for placement within second vertical slots 44 in the hanger bars 12 to thereby releasably secure storage grid 50 to the hanger bars.

Figure 4:
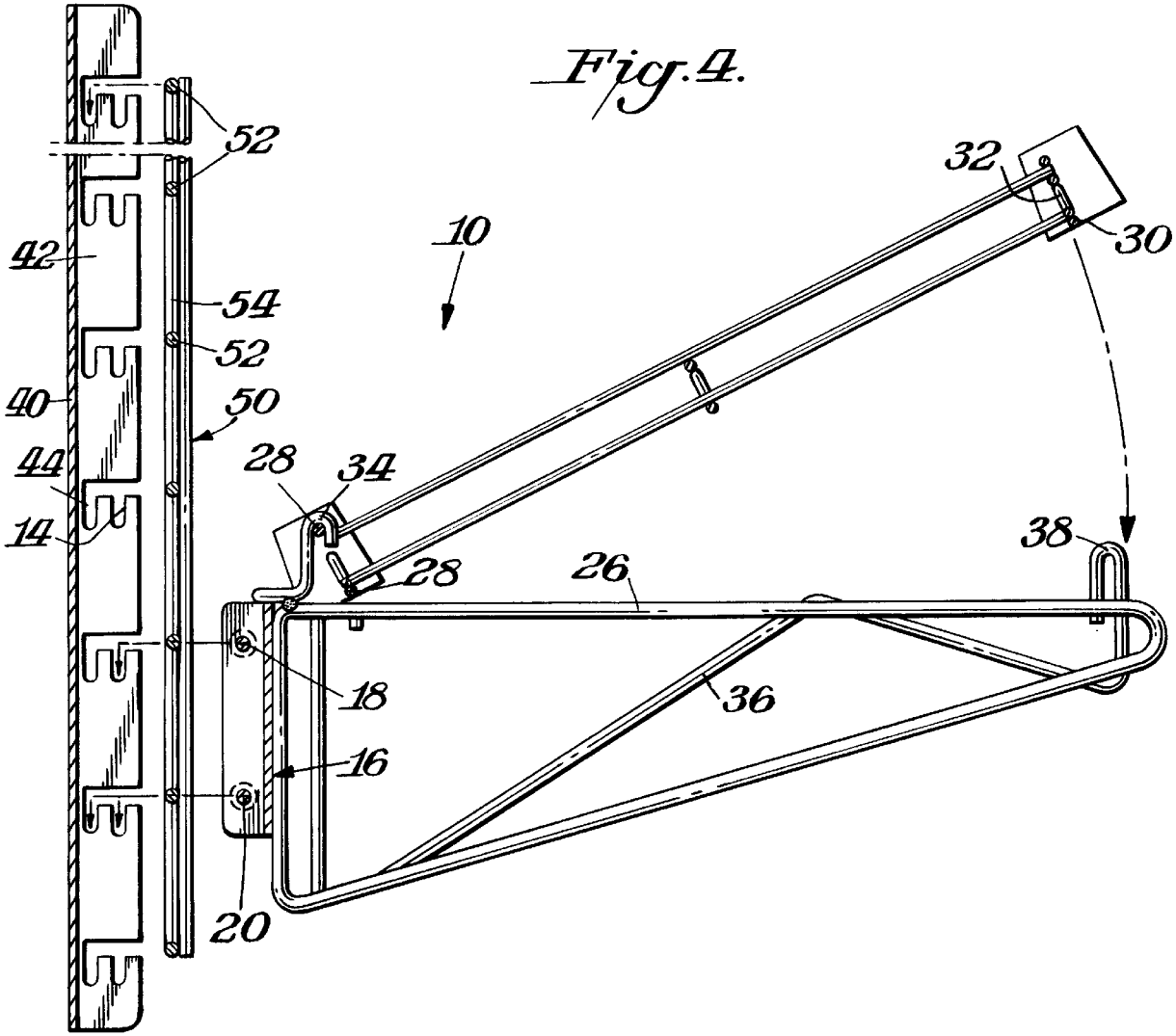
FIG. 4 is an exploded side elevational view illustrating the individual parts of the wall mounted storage system and how they cooperate with one another, according to the present invention.

In actual use of the wall mounted storage system 10, hanger bars 12 are initially secured to wall studs or comparable support structures by any conventional fastening means. Lag bolts or screws, for example, may extend through rear plate 40 into wall studs or comparable support structure. Each hanger bar is vertically oriented so that the arrangement of slots 14, 44 on one bar is horizontally oriented with the arrangement of slots 14, 44 on the other bar. Next, the vertical storage grid 50 is secured to the hanger bars by placement of the horizontal stringers 52 within the second vertical slots 44 in the bars. The shelf support brackets 16 are then releasably secured to the hanger bars at a desired elevation by placing mounting pins 18, 20 within vertical slots 14. If multiple shelving is desired other shelf brackets are similarly secured to the hanger bars. Shelf 22 is then placed on the shelf brackets initially at an angle as shown in FIG. 4 to thereby position rear rail 28 within the shelf hooks 34 on the bracket. The front of shelf 22 is then lowered onto the brackets, and the retainer loops 28 on the brackets engage front rail 30. The exact location of the shelf on the shelf brackets is not critical, and the shelf may be moved more to the right or left, if desired. Such adjustment would be made before the front of the shelf is lowered onto the brackets.

What is claimed is:

1. A wall mounted storage system comprising at least one pair of spaced apart vertical hanger bars, each bar having a plurality of vertical slots equally spaced apart along the bar, at least one shelf support bracket associated with each vertical hanger bar, each shelf support bracket including a pair of vertically spaced apart horizontal mounting pins constructed and arranged for placement within an adjacent pair of vertical slots in its associated hanger bar to thereby releasably secure the shelf support brackets to the hanger bars, and a shelf spanning the shelf brackets and resting thereon, the shelf including front and upwardly extending rear rails, and shelf hooks on the shelf brackets extending above and hooked over the upwardly extending rear rail of the shelf to thereby releasably secure the shelf to the shelf brackets.

2. A wall mounted storage system as in claim 1 wherein each shelf support bracket includes an upwardly extending retainer loop constructed and arranged to engage the front rail of the shelf.

3. A wall mounted storage system comprising at least one pair of spaced apart vertical hanger bars, each bar having a plurality of vertical slots equally spaced apart along the bar, at least one shelf support bracket associated with each vertical hanger bar, each shelf support bracket including a pair of vertically spaced apart horizontal mounting pins constructed and arranged for placement within an adjacent pair of vertical slots in its associated hanger bar to thereby releasably secure the shelf support brackets to the hanger bars, and a shelf spanning the shelf brackets and resting thereon, the shelf including front and rear rails, shelf hooks on the shelf brackets hooked over the rear rail of the shelf to thereby releasably secure the shelf to the shelf brackets, and an upwardly extending retainer loop on each shelf support bracket constructed and arranged to engage the front rail of the shelf, and wherein the shelf includes openings and the retainer loops extend through the shelf openings.

4. A wall mounted storage system as in claim 1 wherein the vertical hanger bars each comprise a base plate for attachment to a wall, integral side plates extending outwardly from the base plate, each side plate having the plurality of vertical slots equally spaced apart along the bar to thereby provide horizontally opposed pairs of vertical slots along each hanger bar.

5. A wall storage system comprising at least one pair of spaced apart vertical hanger bars, each bar having a plurality of vertical slots equally spaced apart along the bar, at least one shelf support bracket associated with each vertical hanger bar, each shelf support bracket including a pair of vertically spaced apart horizontal mounting pins constructed and arranged for placement within an adjacent pair of vertical slots in its associated hanger bar to thereby releasably secure the shelf support brackets to the hanger bars, and a shelf spanning the shelf brackets and resting thereon, the shelf including front and rear rails, shelf hooks on the shelf brackets hooked over the rear rail of the shelf to thereby releasably secure the shelf to the shelf brackets, and wherein the vertical hanger bars each comprise a base plate for attachment to a wall, integral side plates extending outwardly from the base plate, each side plate having the plurality of vertical slots equally spaced apart along the bar to thereby provide horizontally opposed pairs of vertical slots along each hanger bar, and wherein each horizontal mounting pin releasably engages a horizontally opposed pair of vertical slots on its associated hanger bar.

6. A wall mounted storage system comprising at least one pair of spaced apart vertical hanger bars, each bar having a plurality of vertical slots equally spaced apart along the bar, at least one shelf support bracket associated with each vertical hanger bar, each shelf support bracket including a pair of vertically spaced apart horizontal mounting pins constructed and arranged for placement within an adjacent pair of vertical slots in its associated hanger bar to thereby releasably secure the shelf support brackets to the hanger bars, and a shelf spanning the shelf brackets and resting thereon, the shelf including front and rear rails, shelf hooks on the shelf brackets hooked over the rear rail of the shelf to thereby releasably secure the shelf to the shelf brackets, and a plurality of second vertical slots equally spaced apart along each hanger bar, and a vertical storage grid having vertically spaced apart horizontal stringers constructed and arranged for placement within the second vertical slots in the hanger bar to thereby releasably secure the storage grid to the hanger bars.

* * * * *